US007838194B2

(12) United States Patent
Ueda et al.

(10) Patent No.: US 7,838,194 B2
(45) Date of Patent: Nov. 23, 2010

(54) TONER FOR DEVELOPING ELECTROSTATIC IMAGE

(75) Inventors: Noboru Ueda, Tokyo (JP); Asao Matsushima, Tokyo (JP); Go Yamaguchi, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 372 days.

(21) Appl. No.: 11/867,315

(22) Filed: Oct. 4, 2007

(65) Prior Publication Data

US 2008/0138733 A1 Jun. 12, 2008

(30) Foreign Application Priority Data

Dec. 7, 2006 (JP) ..... 2006-330412

(51) Int. Cl.
*G03G 9/087* (2006.01)

(52) U.S. Cl. ..... 430/109.3; 430/110.3

(58) Field of Classification Search ..... 430/109.3, 430/110.3

See application file for complete search history.

(56) References Cited

U.S. PATENT DOCUMENTS

| | | | | |
|---|---|---|---|---|
| 2003/0049553 | A1* | 3/2003 | Nakamura et al. | 430/108.21 |
| 2003/0232267 | A1* | 12/2003 | Fields et al. | 430/108.8 |
| 2006/0029876 | A1* | 2/2006 | Nomiya et al. | 430/110.2 |
| 2007/0111128 | A1* | 5/2007 | Patel et al. | 430/108.4 |

FOREIGN PATENT DOCUMENTS

| | | |
|---|---|---|
| JP | A2001042564 | 2/2001 |

* cited by examiner

*Primary Examiner*—John L Goodrow
(74) *Attorney, Agent, or Firm*—Lucas & Mercanti, LLP

(57) ABSTRACT

A toner for developing an electrostatic image is disclosed. The toner has softening point Tsp of from 90° C. to 110° C., and the toner satisfies the relation of $0.02 \leqq (Sw/S) \times 100 \leqq 10$, Sw being an area of a wax domain having largest diameter among wax domains at a cross section of the toner particle, and S being entire area of the cross section of the toner particle.

9 Claims, 2 Drawing Sheets

TONER FOR DEVELOPING ELECTROSTATIC IMAGE

This application is based on Japanese Patent Application No. 2006-330412 filed on Dec. 7, 2006, in Japanese Patent Office, the entire content of which is hereby incorporated by reference.

TECHNICAL FIELD

The present invention relates to a toner for developing an electrostatic image.

TECHNICAL BACKGROUND

Recently, technology for reducing electric consumption in an image forming apparatus is explored from the viewpoint of consideration on the global environment, and polymerized toner is noticed as a means for solving such the problem. As an example of such the means, a technology is developed by that a fixed image can be formed at a temperature lower than that in the conventional method by using a polymerized toner containing a wax having a low melting point; cf., for example, Patent Document 1.

However, the fixing ability cannot be held only by the use of wax having low melting point in a particularly low fixing temperature range about 100° C. so that rising in the thermal fusibility of the resin itself is required. Accordingly, the wax having low meting point is used in a system of toner resin improved in the fusibility. However, in such the case, the parting ability of the toner from the fixing roller is degraded and a problem of winding the image receiving material onto the fixing roller is frequently posed.

Patent Document 1: JP-A 2001-42564

SUMMARY

An object of the invention is to provide a toner for developing an electrostatic image containing a resin raised in the thermal fusing ability, in which the toner is compatible with the low temperature fixing ability and the parting ability from the fixing roller of the toner.

The object of the invention can be attained by the following constitution.

A toner for developing an electrostatic image comprising a binder resin and wax domains contained therein, wherein the softening point Tsp of the toner is within the range of from 90° C. to 110° C. and the area Sw of the wax domain having largest diameter among the domains at the cross section of the toner and the entire area S of the cross section of the toner satisfy the relation of $0.02 \leqq (Sw/S) \times 100 \leqq 10$.

The binder resin preferably contains as a monomer unit, a vinyl type polymerizable monomer having two or more polar groups in an amount of from 0.2 to 4.0% by weight of the whole polymerizable monomers constituting the binder resin.

A toner for developing an electrostatic image in which the low temperature fixing ability and the parting ability from fixing roller is compatible can be provided by the invention.

THE PREFERABLE EMBODIMENT OF THE INVENTION

Figure 1:
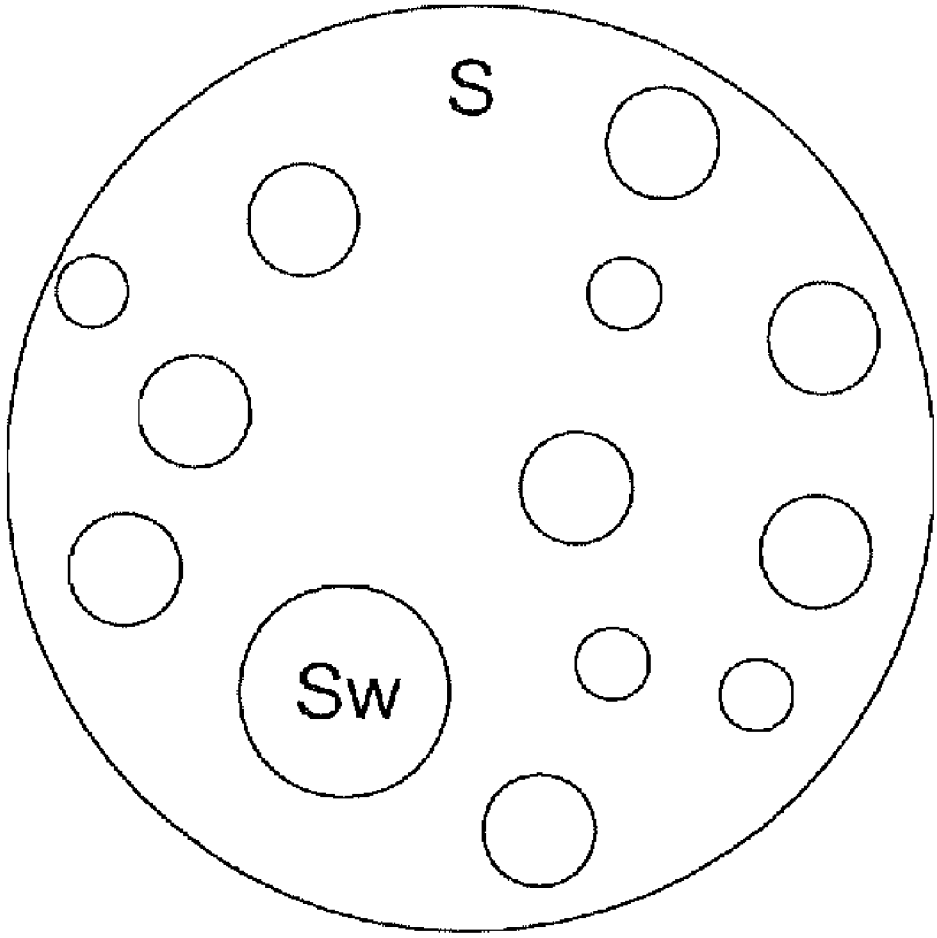
FIG. 1 shows a schematic cross section showing that the wax domain having the largest size exists in the toner particle.

The invention is described in detail below.

The invention of the toner for developing an electrostatic image, hereinafter also referred to as the toner. The softening point Tsp of the toner is from 90° C. to 110° C. and the area Sw of the wax domain having the largest diameter among the wax domains at the cross section of the toner particle and the entire area S of the cross section of the toner particle satisfy the relation of $0.02 \leqq (Sw/S) \times 100 \leqq 10$.

In the above, $(Sw/S) \times 100$ is a value expressing the ratio of the diameter of the largest wax domain to the area of cross section of the toner particle, and is an index of the dispersed state of the wax in the toner particle. The parting effect of the wax can be satisfactorily displayed by making the value of $(Sw/S) \times 100$ to be from 0.02 to 10 (%) so that the parting ability at the low temperature fixing can be satisfied. When the ratio is less than 0.02%, the parting effect cannot be displayed since the wax is dispersed into excessively fine, and when the ratio exceeds 10, the parting effect at the low temperature fixing cannot be obtained since the dispersion state of the wax is too coarse. The parting effect at the fixation can be further improved by making the ratio of $(Sw/S) \times 100$ to be from 0.02 to 3%.

The conventional limitation on the wax domain diameter is that only on the particle size distribution or the average particle diameter, which does not reflect the presence of the largest wax domain diameter most effective to the parting ability at the fixation.

It is considered that the presence of the wax domain having a certain size in the toner particles is important for displaying the effect as the parting agent. However, the wax domains are easily merged with together and grown than the size capable of effectively displaying the parting effect in the toner employing a binder resin having melting ability by heat aiming low temperature fixing.

For holding the low temperature fixing ability, it is necessary to raise the thermal fusibility (to lower the softening point) of the binder resin. The adhesion ability at the low temperature is improved by lowering the softening point of the resin. When the softening point of the resin is lowered, however, the wax domains tend to be merged with together since the binder resin is easily fluidized in the toner particles and the wax contained in the resin is also made easily movable in the production process since the polymerized toner is produced by passing through heating processes such as a polymerization process and a coagulation process.

Moreover, the wax tends to be highly distributed at the central portion of the toner particle because the rein is hydrophilic and the wax is hydrophobic in the comparison of the resin and the wax. Therefore, the wax is highly distributed at the central portion of the toner particle in a form of large domains. As a result of that, the wax is difficultly exuded out onto the toner particle surface and cannot display the parting effect so that the parting ability is lowered in the low temperature fixable toner.

In the invention, such the problem caused in the toner suitable for fixation at low temperature is solved by controlling the diameter of wax domain so as to be within the range of $0.02 \leqq (Sw/S) \times 100 \leqq 10$.

(Measurement of Sw/S)

In the invention, the entire cross section area S of the toner particle and the area Sw of the wax domain having the largest area are measured according to the photograph of sliced layer of the cross section of the toner particle taking by a transmission type electron microscope. The observation can be satisfactorily carried out by an electron microscope usually used by skilled one, for example, LEM-2000 manufactured by Topcon Corp, and JEM-2000FX manufactured by JEOL Ltd.

In concrete, the toner particles are sufficiently dispersed and embedded in ordinal temperature curable epoxy resin and dispersed in styrene fine powder of particle diameter of about 100 nm, and then formed by pressing. Thus obtained block is dyed by ruthenium(II) diruthenium(III) oxide or that together with osmium(II) diosmium(III) oxide according to necessity, and sliced by a microtome having a diamond blade to prepare a sliced sample. The sample is subjected to photographing by the transmission type electron microscope (TEM) at a magnitude, about 10,000 times, so that the cross section of one toner particle is contained in the observation field. Cross-section samples having diameter of 80% or more of the volume average diameter (D4) of the toner particle are selected for the observation, wherein the diameter of the cross-section image is diameter of a corresponding circle having the same area of the cross-section image. The image of the cross-section is read via scanner and digitally processed by employing an image processing analyzer LUZEX AP (marketed by Nireco Corp.) and the each of area of the cross section of the toner particle S is calculated. S is a whole area of the cross section of a toner particle including wax domain area. Then the area of the wax domain is confirmed by visual observation. The area of the wax domain having the largest area among the wax domains Sw is calculated. The Sw/S of one toner particle is obtained from thus obtained values. The Sw/S value of the invention is the average of the values obtained as to 100 particles; cf. FIG. 1.

Such the distribution in the toner particle can be attained by introducing a resin constituted by a monomer composition containing a vinyl type polymerizable monomer having two or more polar groups.

It is supposed that the introduction of the resin constituted by a monomer composition containing a vinyl type polymerizable monomer having two or more polar groups to exist hydrogen bonds in the toner particle and the wax domains are difficultly merged at the portion where the hydrogen bond exists, therefore, dispersing state of the wax in the toner particle is improved so that the wax is dispersed not only at the central portion but also near the surface of the toner particle and the wax is easily exuded to the toner particle surface so as to raise the parting ability, though the detailed reason of that the low temperature fixation ability and the parting ability from the fixing roller can be made compatible by introducing the polar groups is not cleared.

On the other hand, the softening point Tsp of the toner is within the range of from 90° C. to 110° C. by that the low temperature fixation can be attained in the invention. When Tsp is within the range of from 90° C. to 110° C., the thermal fusibility is improved and the mobility of the resin molecular chain is raised even when the fixing temperature is lowered. As a result of that, the toner is easily tangled with the fibers of paper as the image receiving material so as to display the fixing ability causing high image strength against stress such as rubbing. More preferable range of Tsp is from 90 to 100° C.

The softening point $T_{sp}$ can be controlled by controlling the molecular weight of the resin. When the resin is vinyl copolymer, the softening point can be controlled by selection of the copolymerization ratio of the polymerizable monomers. In the case of polyester resin, the softening point can be also controlled by controlling the structure and the copolymerization ratio of the polymerizable polymers. In the case of the vinyl copolymer, for example, a copolymer formed by monomers containing styrene and n-butyl acrylate, the softening point is lowered by reducing the composing ratio of styrene and raising that of n-butyl acrylate. The softening point can be also lowered by lowering the molecular weight of the resin. The molecular weight of the resin can be varied by the amount of the polymerization initiator and that of the chain-transfer agent in the emulsion polymerization.

(Measuring Method of Tsp)

Tsp of the toner is measured by the following method: The particle size of the sample is previously made uniform at a value of 9.2 mesh-pass (opening size of sieve of 2.0 mm) and 32 mesh-on (opening size of sieve 0.5 mm) and formed into a cylinder shape having a height of 10 mm and set in a plunger of a measuring apparatus, for example, Flow Tester CFT-500 manufactured by Shimadzu Corp., and extruded through a nozzle having a diameter of 1 mm and a length of 1 mm while applying a load of $1.96\times10^7$ Pa and heating at a temperature rising rate of 6° C./min. Then a plunger falling distance-temperature curve (softening flowing curve) is drawn and the softening point is determined by a temperature corresponding to a falling distance of 5 mm.

(Material Composition of the Toner)

(Vinyl Type Polymerizable Monomer Having Two or More Polar Groups)

In the invention, the polar group is a group dissociable and capable of forming a slat in an aqueous medium. Concretely, a carboxyl group, a sulfone group, an amino group and an ammonium group can be cited. As the monomer having two or more polar groups usable in the invention, ones having a carboxyl group such as itaconic acid and maleic acid are cited and itaconic acid is particularly preferred.

The adding amount of the vinyl type polymerizable monomer having two or more polar groups is from 0.2 to 4.3% by weight of the whole polymerizable monomers composing the binder resin. The low temperature fixation suitability of the resin is enhanced while inhibiting the dispersing of the parting agent in such the range.

Materials of the Toner to be Used in the Invention (1) Binder Resin

The resin forming the core portion and that forming the shell layer are preferably styrene-acryl type copolymer. For the resin constituting the core portion, a polymerizable monomer lowering the glass transition point Tg of the copolymer such as propyl acrylate, propyl methacrylate, butyl acrylate and 2-ethylhexyl acrylate is preferably copolymerized. For the resin constituting the shell layer, a polymerizable monomer raising the glass transition point Tg of the copolymer such as styrene, methyl methacrylate and methacrylic acid is preferably copolymerized.

The resins constituting the toner of the invention are described in detail below.

As the resin for constituting the core or shell of the toner of the invention, polymers obtained by copolymerizing the following polymerizable monomers can be used.

The resin relating to the invention contains a polymer formed by polymerizing at least one kind of polymerizable monomer as the constituting material thereof. The examples of such the polymerizable monomer include styrene and its derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene and p-n-dodecylstyrene; methacrylate derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate; acrylate derivatives such as methyl acrylate, ethyl acrylate, isopropyl acrylate, n-butyl acrylate, isobutyl acrylate, n-octyl acrylate, 2-ethylhexyl acrylate, stearyl acrylate, lauryl acrylate and phenyl acrylate; olefins such as ethylene, propylene and isobutylene; vinyl halides such as vinyl chloride, vinylidene chloride, vinyl bromide, vinyl fluoride and vinylidene fluoride; vinyl esters such as vinyl propionate, vinyl acetate and vinyl benzoate; vinyl ethers such as vinyl methyl ether and vinyl ethyl ether; vinyl ketones such as vinyl methyl ether, vinyl ethyl ketone and vinyl hexyl ketone; N-vinyl compounds such as N-vinylcarbazole, N-vinylindole and N-vinylpyrrolidone; and acrylic or methacrylic derivatives such as acrylonitrile, methacrylonitrile, and acrylamide. These vinyl type monomers may be used singly or in combination.

Moreover, it is preferable to use a monomer having a polar group as the monomer for constituting the resin. Such the monomer is one having a substituent such as a carboxyl group, a sulfonic acid group and a phosphoric acid group as the constituting group thereof. Concrete examples of that are acrylic acid, methacrylic acid, maleic acid, itaconic acid, cinnamic acid, fumaric acid, monoalkyl maleate, monoalkyl itaconate, styrenesulfonic acid, allylsulfosuccinic acid, 2-acrylamido-2-methylsulfonic acid, acidphosphoxyethyl methacrylate and 3-chloro-2-acidphosphoxypropyl methacrylate.

It is preferable to use a combination of the above monomers having the polar group as the polymerizable monomer constituting the resin.

The resin can be made to one having crosslinked structure by the use of multifunctional vinyl compounds such as divinylbenzene, ethyleneglycol dimethacrylate, ethyleneglycol diacrylate, diethyleneglycol dimethacrylate, diethyleneglycol diacrylate, triethyleneglycol dimethacrylate, triethyleneglycol diacrylate, neopentylglycol dimethacrylate and neopentylglycol diacrylate.

(2) Colorant

As the colorant to be used in the toner of the invention, carbon black, magnetic substances, dyes and pigments can be optionally used. As the carbon black, channel black, furnace black, acetylene black, thermal black and lamp black are usable. The magnetic substance include a ferromagnetic metal such as iron, nickel and cobalt, alloys containing such the metal, compounds of ferromagnetic metal such as ferrite and magnetite, alloys which displays ferromagnetism by heating treatment though contains no ferromagnetic metal such as alloys of manganese-copper-aluminum and manganese-copper-tin so called as Heusler's alloy, and chromium dioxide.

As the dye, C. I. Solvent Reds 1, 49, 52, 58, 63, 112 and 122, C. I. Solvent Yellows 19, 44, 77, 79, 81, 82, 93, 98, 103, 104, 112 and 162, and C. I. Solvent Blues 25, 36, 60, 70, 93 and 95 are usable and mixtures thereof are also usable. Pigments such as C. I. Pigment Reds 5, 48:1, 53:1, 57:1, 122, 139, 144, 149, 166, 177, q78 and 222, C. I. Pigment oranges 31, and 43, C. I. Pigment Yellows 14, 17, 93, 94, 138, 156, 158, 180 and 185, C. I. Pigment Green 7, and C. I. Pigment Blues 15:3 and 60 are usable and mixtures thereof are also usable. The number average primary particle diameter is preferably about from 10 to 200 nm though the diameter is various according to the kind of the colorant.

The colorant is added on the occasion of coagulation of the resin fine particles by adding a coagulation agent for coloring the polymer. The colorant may be used after surface treatment by a coupling agent.

(3) Wax (Parting Agent)

As the wax to be used in the toner of the invention, usually known ones are usable. Concrete examples of the wax include polyolefin waxes such as polyethylene wax and polypropylene wax; long chain hydrocarbon waxes such as paraffin wax and SASOL wax; dialkyl ketone waxes such as distearyl ketone; ester type waxes such as carnauba wax, montan wax, trimethylolpropane tribehenate, pentaerythritol tetramyristate, pentaerythritol tetrastearate, pentaerythritol tetrabehenate, pentaerythritol diacetate dibehenate, glycerin tribehenate, 1,18-octadecanediol distearate, tristearyl trimellitate and distearyl maleate; and amide type waxes such as ethylenediamine dibehenylamide and trimellitic stearylamide.

The melting point of the wax is usually from 40 to 160° C., preferably from 50 to 120° C., and more preferably from 60 to 90° C. When the melting point is within the above range, the storage ability against heating can be held and the cold-offset is not caused even when the low temperature fixation is applied so that a toner image can be stably formed. The containing amount of the wax in the toner particles is preferably from 1 to 30% by weight and more preferably from 5 to 20% by weight.

Polymerization initiators, chain transfer agents and surfactants usable in the production process of the above toner are described below.

(4) Radical Polymerization Initiator Usable in the Invention

The resins constituting the core and the shell of the toner particle of the invention is formed by polymerizing the above-mentioned polymerizable monomers. The radical polymerization initiator usable in the invention includes followings. Concrete examples of the oil-soluble polymerization initiator include azo type or diazo type polymerization initiator such as 2,2'-azobis(2,4-dimethyl-valeronitrile), 2,2'-azobisisobutylonitrile, 1,1'-azobis-(cyclohexane-1-carbonitrile) and 2,2'-azobis(4-methoxy-2,4-dimethylvaleronitrile); peroxide compound type polymerization initiators such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis(4,4-t-butylperoxycyclohexyl)propane and tris(t-butylperoxy)triazine; and polymer initiators having peroxide on the side chain thereof.

When the resin particle is formed by an emulsion polymerization method, water-soluble radical polymerization initiators are usable. As the water-soluble polymerization initiator, persulfates such as potassium persulfate and ammonium persulfate, azobisaminopropane acetate salt, azobiscyanovaleric acid and its salt and hydrogen peroxide are usable.

Usually used chain transfer agents can be used for controlling the molecular weight of the resin constituting the composite rein particle.

For example, mercaptans such as octylmercaptan, dodecylmercaptane and t-dodecylmercaptane, n-octyl-3-mercapto-propionic acid esters, terpinolene, carbon tetrabromide and α-methylstyrene dimer are usable even though the chain transfer agent is not specifically limited.

(5) Dispersion Stabilizer

A dispersion stabilizer can be used for suitably and stably dispersing the polymerizable monomer in the reaction system. As the dispersion stabilizer, tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina are usable. Moreover, compounds usually used as surfactant such as poly(vinyl alcohol), gelatin, methylcellulose, sodium dodecylbenzenesulfonate, ethylene oxide adducts and sodium higher alcohol sulfate can be used for the dispersion stabilizer.

The surfactants to be used in the invention are described below.

For carrying out polymerization using the foregoing radical polymerizable monomers, the monomer should be dispersed into an oil droplet state in an aqueous medium by using the surfactant. Suitable examples of the surfactant usable for dispersing the monomer are described below even though the surfactant is not specifically limited.

As the surfactant, sulfonic salts such as sodium dodecylbenzenesulfonate, sodium arylalkylpolyethersulfonate, sodium 3,3-disulfonediphenylurea-4,4-diazo-bis-amino-8-naphthol-6-sulfonate, ortho-carboxybenzene-azo-dimethylaniline, and sodium 2,2,5,5-tetramethyl-triphenyl-methane-4,4-azo-bis-β-naphthol-6-sulfonate; and fatty acid salts such as sodium oleate, sodium laurate, sodium caprate, sodium caprylate, sodium caproate, potassium stearate and calcium oleate are cited.

Nonionic surfactants can be also used. Concrete examples of such the surfactant include polyethylene oxide, polypropylene oxide, a combination of polypropylene oxide and polyethylene oxide, an ester of polyethyleneglycol and a higher fatty acid, an alkylphenolpolyethylene oxide, an ester of polyethyleneglycol and a higher fatty acid, an ester of propylene oxide and a higher fatty acid and a sorbitan ester.

As the production method of the toner of the invention, an emulsion polymerization-coagulation method, a mini-emulsion polymerization-coagulation method, a suspension polymerization method, a dispersion polymerization method, a melt-suspension method and a knead-crushing method are applicable. Among them, the mini-emulsion polymerization-coagulation method and the emulsion polymerization-coagulation method are preferable for producing the toner because the diameter of the wax domain can be easily controlled.

A concrete example of toner production by the mini-emulsion polymerization-coagulation method is described below.

(1) A dissolving/dispersing process in which the parting agent is dissolved or dispersed in the radical polymerizable monomer.

(2) A polymerization process in which the polymerizable monomer solution or dispersion of the parting agent is made to droplets in the aqueous medium and mini-emulsion polymerized to obtain a dispersion of resin particles.

(3) A coagulation and fusion process in which the resin particles are associated to form associated particles.

(4) A ripening process in which the shape of associated particle is controlled by ripening by thermal energy to form mother particles of toner.

(5) A cooling process for cooling the dispersion of mother particles of toner.

(6) A washing process in which the mother particles of toner are separated from the cooled dispersion and the surfactant is removed from the mother particles of toner.

(7) A drying process for drying the washed mother particles of toner.

(8) A process for adding the external additive to the dried mother particles of toner.

Each of the above processes is described below.

(1) Dissolving/Dispersing Process

In this process, the parting agent is dissolved or dispersed in the radical polymerizable monomer to prepare a radical polymerizable monomer solution of the parting agent.

(2) Polymerization Process

In a suitable example of this process, the above radical polymerizable monomer solution or dispersion of the parting agent is added to an aqueous medium containing a surfactant and made into droplets state by applying mechanical energy, and then polymerization reaction is progressed in each of the droplets by radical derived from a water-soluble radical polymerization initiator. Resin particles may be previously added into the aqueous medium as nuclear particles.

Resin particles containing the parting agent and the binder resin are obtained by the polymerization process. The rein particle may be colored or not colored. The colored resin particle can be obtained by polymerizing a monomer composition containing a colorant. When the non-colored resin particles are used, colored particles can be obtained by adding a dispersion of colorant particles to the dispersion of the resin particles in the later-mentioned coagulation process for coagulating the colorant particles with the resin particles.

(3) Coagulation and Fusion Process

In the coagulation process, colored particles are formed by using the resin particles (colored or non-colored resin particles) and the colorant particles. Internal additive particles such as parting agent particles and charge controlling agent can be coagulated with the resin particles and the colorant particles.

The colorant dispersion can be prepared by dispersing the colorant in an aqueous medium. The dispersing treatment of the colorant is carried out in ware in the presence of a surfactant at a concentration of not less than the critical micelle concentration (CMC). A ultrasonic wave dispersing machine, a mechanical dispersing machine, a pressure applying dispersing machine such as Manton-Gaulin homogenizer and a pressure applying homogenizer, and a medium type dispersion machine such as a sand grinder, a Getzman Mill and a diamond fine mill are preferably applied as the dispersion machine to be used for dispersing the colorant though the dispersing machine is not specifically limited.

The colorant particle may be modified on the surface thereof. The surface modification of the colorant particle can be carried out by dispersing the colorant into the medium and adding a surface modifying agent and heating for occurring reaction. After completion of the reaction, the colorant is separated by filtration and repeatedly washed by the same solvent and dried to obtain the surface modified colorant (pigment) particles.

Preferable method for coagulation is a method in which a coagulation agent composed of an alkali metal salt or an alkali-earth metal salt in an concentration higher than the critical coagulation concentration is added to water in which the resin particles and the colorant particles are contained and then the particles are coagulated at a temperature higher than the glass transition point of the resin particles.

(4) Ripening Process

The ripening is preferably carried out by thermal energy or heating. Concretely, the liquid containing the associated particles is heated and stirred until the shape of the associated particle comes up to desired circularity while controlling the heating temperature, stirring speed and heating time to form the mother particles of toner.

(5) Cooling Process

This process is a process for cooling the dispersion of the mother particles of toner. The cooling is preferably carried out at a cooling rate of from 1° C. to 20° C. per minute. As the cooling method, a method by introducing a cooling medium to outside of the reaction vessel and a method by directly pouring cold water into the reaction system can be exemplified.

(6) Washing Process

In this process, a treatment for separating the mother particles of toner from the dispersion after cooled by desired temperature in the above cooling process and a washing treatment for removing the adhering materials such as the surfactant and the salting-out agent from the cake of toner (a cake-shaped lump of the mother particles of toner in wetted state) separated from the liquid are carried out.

The washing treatment is carried out by water until the electroconductivity of the filtrate comes up to 10 μS/cm. For the filtration treatment, a centrifugal method, a reduce pressure filtering method using a Buchner's funnel and a filtration using a filter press are applicable.

(7) Drying Process

In this process, the washed toner cake is dried to obtain dried mother particles of toner. As the drying machine to be used in the process, a spray dryer, a vacuum freezing drying machine and a reduced pressure drying machine are usable, and a still standing type rack dryer, a moving rack dryer, a fluidizing dryer, a rotary dryer and a stirring dryer are preferably used. Moisture content in the dried colored particles is preferably not more than 5% and more preferably not more than 2% by weight. When the dried color particles are coagulated with together by weak inter-particle attractive force, the coagulated particles may be subjected to crushing treatment. For the crushing, a mechanical apparatus such as a jet mill, a Henschel mixer, a coffee mill and a food processor are usable.

(8) External Additive Adding Process

This process is a process in which an external additive is mixed with the mother particles of toner according to necessity to prepare the toner. A mechanical mixing apparatus such as a Henschel mixer and a coffee mil are usable as the external additive mixing apparatus.

In the toner production by the mini-emulsion polymerization coagulation method, the resin composed of monomers containing the vinyl type monomer having two or more polar groups, hereinafter referred to as Copolymer B, can be introduced in the following Process (I) or (II).

(I) A method for introducing the resin in the polymerization process (2): Concretely the following methods (I-a) to (I-c) are applicable.

(II) A method for introducing the resin in the coagulation and fusion process (3): Concretely the following methods (II-a) and (II-b) are applicable.

(I-a) A method in which fine particles of Copolymer B is previously added into the oil droplet of the radical polymerizable monomer solution for forming the vinyl type copolymer on the occasion of performing the mini-emulsion polymerization in the polymerization process (2) so as to introduce Copolymer B to the central portion of the toner particle.

(I-b) A method for introducing Copolymer B in which a solution of radical polymerizable monomer for forming Copolymer B is made to oil droplets in an aqueous medium and subjected to mini-emulsion polymerization in the polymerization process (2) to obtain fine particles of Copolymer B and then emulsion polymerization is carried out using a radical polymerizable monomer for forming a resin composed of the monomer containing no vinyl type copolymer having two or more polar groups, hereinafter referred to as Copolymer A.

(I-c) A method in which the mini-emulsion polymerization of Copolymer A in the polymerization process (2) is carried out and then emulsion polymerization (multi-step polymerization) using the radical polymerizable monomer solution for forming Copolymer B is performed for introducing Copolymer B to near surface portion of the toner particle.

Among these methods, the introducing method of (I-a) is preferable.

(II-a) A method in which resin particles of Copolymer B is added to the aqueous medium simultaneously with the addition of resin particles of Copolymer A in the coagulation-fusion process (3) and Copolymer B is introduced by coagulation of them.

(II-b) A method in which resin fine particles of Copolymer B is added to the aqueous medium in the course of starting to completion of the coagulation of the resin particles of Copolymer A in the coagulation and fusion process (3) so as to be introduced Copolymer B by coagulation of them.

In the above, the aqueous medium is a medium composed of from 50 to 100% by weight of water and from 0 to 50% by weight of a water-soluble organic solvent. As the water-soluble organic solvent, methanol, ethanol, isopropanol, butanol, acetone, methyl ethyl ketone, tetrahydrofuran can be exemplified. The alcohol type organic solvent capable of not dissolving the resin is preferable.

The weight average diameter (diameter of dispersed particle) of the composite resin particles is preferably within the range of from 10 to 1,000 nm and more preferably from 30 to 300 nm. The weight average particle diameter is a value measured by an electrophoretic light scattering photometer ELS-800 manufactured by Otsuka Electronics Co., Ltd.

In the above toner production method by the mini-emulsion polymerization-coagulation method, the vinyl type monomer having two or more polar groups can be introduced in the following process I or II.

[Developer]

The toner of the invention may be used in a form of double-component developer by mixing a carrier though the toner can be also used as a magnetic or non-magnetic single-component developer. When the toner of the invention is used as the double-component developer, a magnetic powder composed of a known material such as a metal, for example, iron ferrite, magnetite and an alloy of such the metal and aluminum or lead can be used as the carrier and the ferrite particle is particularly preferred.

A coated carrier composed of magnetic particles coated with resin on the surface thereof and a binder type carrier composed of particles of binder resin in which the fine particles of magnetic material are dispersed may be used as the carrier. The coating resin constituting the coated carrier is not specifically limited and an olefin type resin, a styrene type resin, a styrene-acryl type resin, a silicone type resin, an ester type resin and a fluororesin are usable, for example. As the binder resin constituting the binder type carrier is not specifically limited and usually known resin such as a styrene-acryl type resin, a polyester resin, a fluororesin and a phenol type resin are usable.

Figure 2:
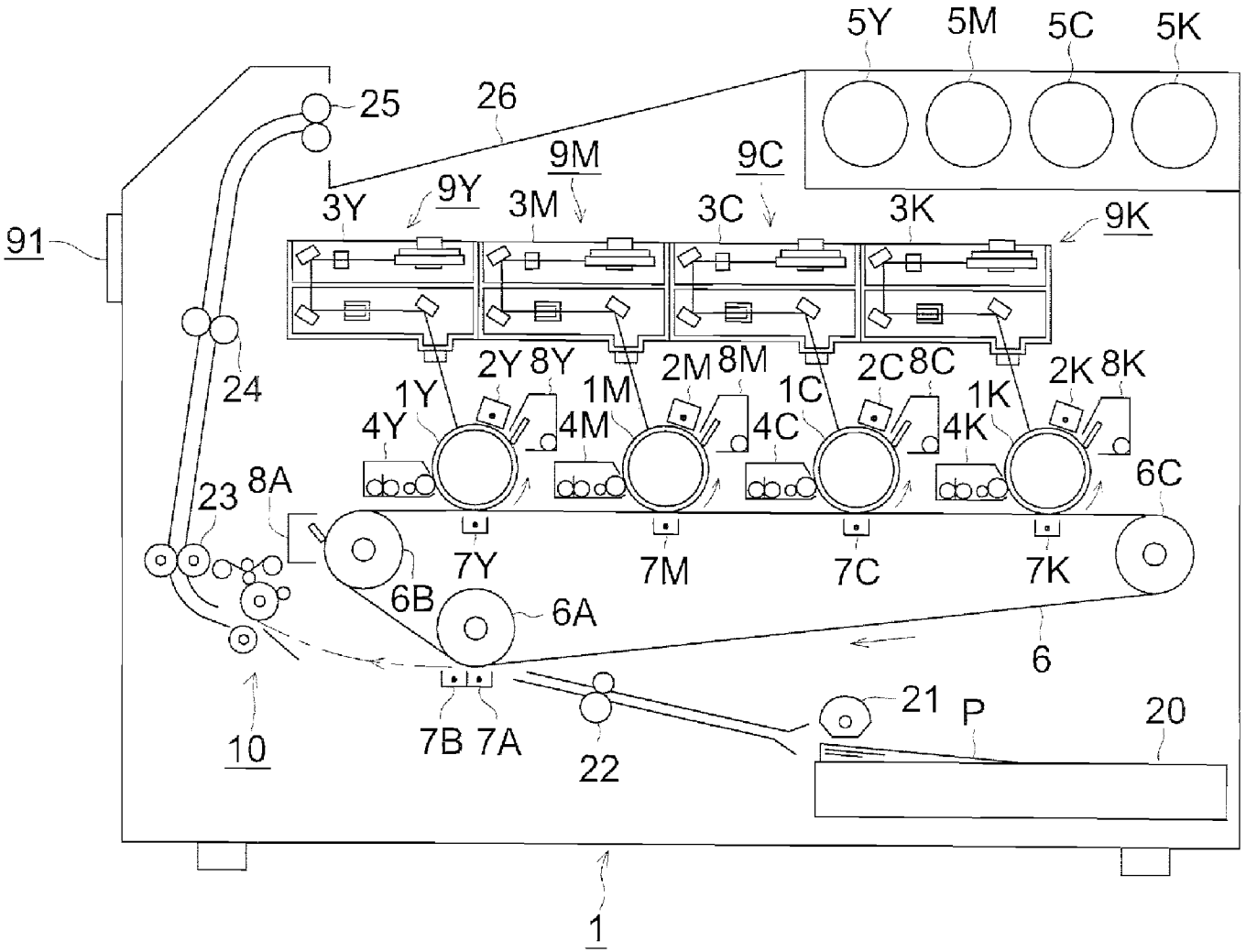
FIG. 2 shows a schematic drawing of an image forming apparatus relating to the invention.

FIG. 2 is a schematic drawing of an example of image forming apparatus relating to the invention.

As is shown in FIG. 2, this image forming apparatus 1 is a machine so called as tandem type color image forming apparatus which comprises plural image forming units 9Y, 9M, 9C and 9K, a belt-shaped intermediate transfer member 6, a paper supplying means, a paper transferring means, toner cartridges 5Y, 5M, 5C and 5K, a fixing device 10 of the invention and a operation panel 91.

The image forming unit 9Y for forming a yellow image has an image carrying member 1Y, hereinafter referred to as a photoreceptor, and a charging means 2Y, an exposing means 3Y, a developing device 4Y, a transferring means 7Y and a cleaning means 8Y each arranged around the photoreceptor 1Y. The image forming unit 9M for forming a magenta image has an image carrying member 1M, a charging means 2M, an exposing means 3M, a developing device 4M, a transferring means 7M and a cleaning means 8M. The image forming unit 9C for forming a cyan image has an image carrying member 1C, a charging means 2C, an exposing means 3C, a developing device 4C, a transferring means 7C and a cleaning means 8C. The image forming unit 9K for forming a black image has an image carrying member 1K, a charging means 2K, an exposing means 3K, a developing device 4K, a transferring means 7K and a cleaning means 8K.

The intermediate transfer member 6 is winded on plural rollers 6A, 6B and 6C and rotatably supported.

Individual color images formed by each of the image forming units 9Y, 9M, 9C and 9K are primarily transferred successively onto the intermediate transfer member 6 by the transferring means 7Y, 7M, 7C and 7K to compose a composite image.

Paper P stored in a paper supplying cassette 20 as the paper supplying means is supplied one by one and conveyed to the transferring means 7A and 7B through a resist roller 22 and the color image is secondarily transferred onto the paper P. Residual toner on the intermediate transfer member 6 is removed by a cleaning device 8A.

The color image transferred onto the paper P is fixed by the fixing device 10 and the paper P is conveyed through conveying rollers 23 and 24 and placed on a output paper tray 26 by a taking out roller 25.

EXAMPLES

The Invention is described below referring examples but embodiment of the invention is not limited to the examples. In the followings, "parts" expresses "parts by weight".

<<Preparation of Resin Fine Particle Dispersion A-1>>

(1) First Step Polymerization

In a 5 L reaction vessel on which a stirring device, a thermo sensor, a reflux cooler and a nitrogen gas introducing device were attached, a surfactant solution prepared by dissolving 2.0 g of anionic surfactant (sodium dodecylbenzenesulfonate (SDS) in 2,900 g of deionized water was previously charged and the internal temperature was raised by 80° C. while stirring at a rate of 230 rpm under nitrogen gas atmosphere.

To the above surfactant solution, 9.0 g of a polymerization initiator (potassium persulfate: KPS) was added and the internal temperature was lowered by 78° C. And then the following monomer solution 1 was dropped spending 3 hours.

| | |
|---|---|
| Styrene | 551 g |
| n-butyl acrylate | 280 g |
| Methacrylic acid | 44 g |
| n-octyl mercaptan | 19 g |

After completion of the dropping, the polymerization (first step polymerization) was carried out by heating and stirring the resultant dispersion at 78° C. for 1 hour to prepare a dispersion of resin fine particles (Resin Fine Particle Dispersion a1). The weight average molecular weight Mw was 14,000.

(2) Second Step of Polymerization: Formation of Intermediate Layer

In a flask having a stirring device, 51 g of paraffin wax HNP-57, manufactured by Nihon Seiro Co., Ltd., was added to a monomer composition composed of 104 g of styrene, 53 g of n-butyl acrylate, 8 g of methacrylic acid and 4 g of n-octylmercaptan and dissolved by heating 85° C. to prepare a monomer solution 2.

On the other hand, a surfactant solution composed of 2 g of an anionic surfactant (sodium polyoxyethylene (2) dodecyl ether sulfate, $C_{12}H_{25}OC(CH_2CH_2O)_2SO_3Na$) dissolved in 1,100 g of deionized water was heated by 90° C. and 28 g in terms of solid component of Resin Fine Particle Dispersion a1 was added in the resultant liquid and then the above monomer solution 2 was mixed and dispersed for 4 hours by a mechanical dispersing machine having a circulation pass CLEARMIX, manufactured by M Technique Co., to prepare a dispersion containing emulsified particles having a dispersed particle diameter of 530 nm. To the dispersion, an initiator solution prepared by dissolving 2.5 g of the polymerization initiator (KPS) in 110 g of deionized water was added and the system was heated and stirred for 2 hours at 90° C. to perform polymerization (second step polymerization) to prepare a dispersion of resin fine particles (Resin Fine Particle Dispersion all). The weight average molecular weight Mw was 35,000.

(3) Third Step Polymerization

An aqueous initiator solution prepared by dissolving 2.5 g of the polymerization initiator (KPS) in 110 g of deionized water was added to the above Resin Fine Particle Dispersion a11 and the following monomer solution 3 was dropped into the dispersion spending 1 hour at 80° C.

| | |
|---|---|
| Styrene | 231 g |
| n-butyl acrylate | 99 g |
| n-octylmercaptan | 4.2 g |

After completion of the dropping, polymerization (third step polymerization was performed by heating and stirring for 3 hours and then the system was cooled by 28° C. Thus Resin Fine Particle Dispersion A1 was obtained which contained composite resin fine particles having a three-layer structure. The weight average molecular weight Mw was 18,000.

The glass transition point Tg of the composite resin fine particle constituting Resin Fine Particle Dispersion A1 was 30.2° C.

<<Preparation of Resin Fine Particle Dispersion A2>>

Resin Fine Particle Dispersion A2 was prepared in the same manner as I Resin Fine Particle Dispersion A1 except that the composition of monomer solution 3 was replaced by the followings.

| | |
|---|---|
| Styrene | 241 g |
| n-butyl acrylate | 89 g |
| n-octylmercaptan | 4.0 g |

The weight average molecular weight Mw was 22,000.

The glass transition point Tg of the composite resin fine particle constituting Resin Fine Particle Dispersion A2 was 35.1° C.

<<Preparation of Resin Fine Particle Dispersion A3>>

(1) First Step Polymerization

In a 5 L reaction vessel on which a stirring device, a thermo sensor, a cooler tube and a nitrogen introduction device were attached, 70 g of paraffin wax HNP-57, manufactured by Nihon Seiro Co., Ltd., was added as a parting agent to a monomer composition composed of 121 g of styrene, 46 g of n-butyl acrylate, 9 g of methacrylic acid and 2.6 g of n-octylmercaptan and dissolved by heating by 80° C. to prepare a monomer solution 1.

On the other hand, a surfactant solution composed of 1.5 g of an anionic surfactant (sodium polyoxyethylene (2) dodecyl ether sulfate) dissolved in 650 g of deionized water was heated by 90° C. and the above monomer solution 1 was mixed and dispersed for 3 hours by a mechanical dispersing machine having a circulation pass, CLEARMIX manufactured by M Technique Co., to prepare a dispersion containing emulsified particles having a dispersed particle diameter of 210 nm. To the dispersion, 700 g of deionized water heated by 90° C. was added and an initiator solution prepared by dissolving 3 g of the polymerization initiator (KPS) in 120 g of deionized water was further added and the system was heated by 82° C. and stirred for 3 hours to perform polymerization (first step polymerization) to prepare a dispersion of resin fine particles (Resin Fine Particle Dispersion a3). The weight average molecular weight Mw was 25,000.

(2) Second Step Polymerization: Formation of Outer Layer

The above Resin Fine Particle Dispersion a3, an initiator solution prepared by dissolving 3 g of the polymerization initiator (KPS) in 120 g of deionized water was added and the following monomer solution 4 was dropped into the resultant liquid spending 1 hour at 80° C.

| | |
|---|---|
| Styrene | 248 g |
| n-butyl acrylate | 82 g |
| n-octylmercaptan | 3.5 g |

After completion of the dropping, polymerization (second step polymerization) was performed by heating and stirring for 3 hours, and then cooled by 28° C. to prepare Resin Fine Particle Dispersion A3 comprising composite resin particles having multi-layered structure. The weight average molecular weight Mw was 20,000.

The glass transition point Tg of the composite resin fine particle constituting Resin Fine Particle Dispersion A3 was 40.3° C.

<<Preparation of Resin Fine Particle Dispersion AB-1>>

Resin Fine Particle Dispersion AB-1 was prepared in the same manner as in Resin Fine Particle Dispersion A1 except that the composition of monomer solution 1 was changed as follows.

| | |
|---|---|
| Styrene | 16 g |
| Methyl methacrylate | 612 g |
| n-butyl acrylate | 132 g |
| Itaconic acid | 40 g |
| n-octylmercaptan | 14 g |

The resin fine particle contained in Resin Fine Particle Dispersion AB-1 was constituted by a core portion comprising copolymer derived from monomers containing itaconic acid and an outer shell comprising a resin layer composed of the vinyl type copolymer. The weight average molecular weight Mw was 18,500.

The glass transition point of the core portion constituting the particle of Resin Fine Particle Dispersion AB-1 was 30.2° C. and the glass transition point of the whole particle was 30.4° C.

TABLE 1

| Resin particle dispersion | Composition Substance | Weight % | Substance | Weight % | Substance | Weight % | Tg (° C.) | Molecular weight |
|---|---|---|---|---|---|---|---|---|
| A1 | Styrene | 63 | n-butyl acrylate | 32 | Methacrylic acid | 5 | 30.2 | 18,000 |
| A2 | Styrene | 65 | n-butyl acrylate | 29 | Methacrylic acid | 6 | 35.1 | 25,000 |
| A3 | Styrene | 70 | n-butyl acrylate | 27 | Methacrylic acid | 3 | 40.3 | 20,000 |
| AB1 | Styrene | 64.2 | n-butyl acrylate | 29.9 | Methacrylic acid | 1.5 | 30.4 | 18,500 |
| | Methyl-methacrylate | 4.1 | Itaconic acid | 0.3 | | | | |

<<Preparation of Resin Fine Particle Dispersion B-1>>

To a 5 L reaction vessel on which a stirring device, a thermo sensor, a cooling tube and a nitrogen introduction device were attached a surfactant solution prepared by dissolving 2.7 g of the anionic surfactant (SDS) in 2,800 g of deionized water was previously charged and the internal temperature was raised by 80° C. while stirring at 230 rpm under nitrogen atmosphere. On the other hand, the following composition was mixed and dissolved by heating by 78° C. to prepare a monomer solution.

| | |
|---|---|
| Styrene | 16 g |
| Methyl methacrylate | 612 g |
| n-butyl acrylate | 132 g |
| Itaconic acid | 40 g |
| n-octylmercaptan | 14 g |

Then the monomer solution and the foregoing surfactant solution were mixed and dispersed by a mechanical dispersing machine having a circulation pass to prepare emulsified particles uniform in the dispersed particle size. And then a solution prepared by dissolving 11.0 g of the polymerization initiator (KPS) in 400 g of deionized water was added to the resultant dispersion and heated and stirred for 2 hours at 78° C. to obtain Resin Fine Particle Dispersion B1.

The glass transition point Tg of the composite resin fine particle constituting Resin Fine Particle Dispersion B1 was 62° C.

<<Preparation of Resin Fine Particle Dispersions B2 to B10>>

Resin Fine Particle Dispersions B2 to B10 were each obtained in the same manner as in Resin Fine Particle Dispersion B1 except that the kind and the ratio of the monomers were charged to as a described in Table 2. The glass transition point Tg of each of the resin fine particles constituting Resin Fine Particle Dispersions B2 to B10, respectively, were shown in Table 2.

TABLE 2

| Fine resin particle dispersion | Composition Substance | Weight % | Substance | Weight % | Substance | Weight % | Substance | Weight % | Tg (° C.) | Molecular weight |
|---|---|---|---|---|---|---|---|---|---|---|
| B1 | Styrene | 2 | Methyl methacrylate | 77 | n-butyl acrylate | 16 | Itaconic acid | 5 | 62 | 16,000 |
| B2 | Styrene | 2 | Methyl methacrylate | 68 | n-butyl acrylate | 20 | Itaconic acid | 10 | 60 | 20,000 |
| B3 | Styrene | 2 | Methyl methacrylate | 61 | n-butyl acrylate | 22 | Itaconic acid | 15 | 60 | 18,000 |
| B4 | Styrene | 2 | Methyl methacrylate | 79 | n-butyl acrylate | 18 | Itaconic acid | 1 | 60 | 23,000 |
| B5 | Styrene | 2 | Methyl methacrylate | 68 | n-butyl acrylate | 25 | Itaconic acid | 5 | 48 | 26,000 |
| B6 | Styrene | 2 | Methyl methacrylate | 62 | n-butyl acrylate | 31 | Itaconic acid | 5 | 36 | 17,000 |
| B7 | — | — | Methyl methacrylate | 76 | n-butyl acrylate | 19 | Itaconic acid | 5 | 60 | 15,000 |
| B8 | Styrene | 77 | — | — | n-butyl acrylate | 18 | Itaconic acid | 5 | 60 | 22,000 |
| B9 | Styrene | 2 | Methyl methacrylate | 74 | n-butyl acrylate | 19 | Maleic acid | 5 | 60 | 12,000 |
| B10 | Styrene | 2 | Methyl methacrylate | 73 | n-butyl acrylate | 20 | Methacrylic acid | 5 | 60 | 38,000 |

<<Preparation of Colorant Dispersion 1>>

To a solution prepared by dissolving 90 g of sodium dodecylsulfate in 1,600 g of deionized water, 240 g of carbon black Regal 330R, manufactured by Cabot Corp., was gradually added while stirring and then dispersed by the stirring apparatus CLEARMIX, manufactured by M Technique Co., to obtain Colorant Dispersion 1. The average particle diameter of the colorant particles was 110 nm according to measurement by the electrophoretic light scattering photometer ELS-800, manufactured by Otsuka Electronics Co., Ltd.

Preparation of Colored Particle 1

To a 5 L reaction vessel on which a stirring device, a thermo sensor, a cooler tube and a nitrogen gas introducing device, 360 g in terms of solid component of Resin Fine Particle Dispersion A1 and 40 g in terms of solid component of Resin Fine Particle Dispersion B1, 1,100 g of deionized water and 200 g of Colorant Dispersion 1 were charged and the temperature of the resultant mixture was adjusted to 30° C. and then the pH of the mixture was adjusted to 10.0 by adding a 5M aqueous solution of sodium hydroxide. After that, an aqueous solution prepared by dissolving 60 g of magnesium chloride in 60 g of deionized water was added spending 10 minutes while stirring at 30° C. Thereafter, the liquid was stood for 3 minutes and then the temperature of the liquid was raised by 80° C. spending 60 minutes and held at 80° C. for continuing growth of the particles.

In such the situation, the size of the associated particle was measured by Coulter Multisizer 3, manufactured by Beckman Coulter, Inc. and an aqueous solution prepared by dissolving 190 g of sodium chloride in 760 g of deionized water was added to stop growth of the particle at the time when the volume based median diameter of the particle came up to 6 μm and then further heated and stirred at 80° C. as the ripening process and then cooled by 30° C. and stirring was stopped at the time when the sphericity of the particle was made to designated value.

Thus prepared fused particles were filtered and washed by deionized water and then dried by Flash Dryer, manufactured by Seishin Enterprise Co., Ltd., until the moisture content was made to not more than 1.0% by weight to obtain Colored Particle 1 according to the invention. The volume average median diameter and the circular degree of Colored Particle 1 were 6.0 μm and 0.955, respectively.

Preparation of Colored Particles 2 to 9 and 11 to 14

Colored Particles 2 to 9 and 11 to 14 were prepared in the same manner as I Colored Particle 1 except that the combination and the composing ratio of Resin Fine Particle Dispersions A1 to A3 and Resin Fine Particle Dispersions B1 to B10 were changed as shown in Table 3.

Preparation of Colored Particle 10

Colored Particle 10 was prepared in the same manner as in Colored Particle 1 except that 360 g in terms of solid component of Resin Fine Particle Dispersion A1 and 40 g in terms of solid component of Resin Fine Particle Dispersion B1 were replaced by 400 g in terms of solid component of Resin Fine Particle Dispersion AB1.

External Additive Treatment of Colored Particle

To each of Colored Particles 1 to 11 of the invention and Colored Particles 12 to 14 for comparison, 1% by weight of hydrophobic silica having a number average primary particle diameter of 12 nm and a hydrophobicity of 68 and 1% by weight of hydrophobic titanium oxide having a number average primary particle diameter of 20 nm and a hydrophobicity of 63 were added and mixed by a Henschel mixer, manufactured by Mitsui Miike Kakoki Co., Ltd., and then sieved through a sieve having a opening size of 45 μm for removing coarse particles. Thus Toners 1 to 11 of the invention and Toners 12 to 14 for comparison were obtained.

The shape and the particle size of each of the Toners 1 to 14 were not varied by the addition of the hydrophobic silica and titanium oxide.

The status of the presence of the wax in each of the toners was confirmed by observation of the cross section of each of Toners 1 to 11 by a transmission electron microscope (TEM). The results of the observation are shown in Table 3 together with the Tsp of the toners.

TABLE 3

| Toner No. | Binder resin composition: Resin A Substance | Resin A Weight % | Resin B Substance | Resin B Weight % | Vinyl type polymerizable monomer having two or more polar groups: Kind | Amount | Tsp of toner (° C.) | (Sw/S) × 100 |
|---|---|---|---|---|---|---|---|---|
| 1 | A1 | 90 | B1 | 10 | *1 | 0.50 | 90 | 10.00 |
| 2 | A2 | 85 | B2 | 15 | *1 | 1.50 | 108 | 0.05 |
| 3 | A3 | 73 | B3 | 27 | *1 | 4.00 | 110 | 0.02 |
| 4 | A2 | 80 | B4 | 20 | *1 | 0.20 | 99 | 3.00 |
| 5 | A2 | 98 | B5 | 2 | *1 | 0.10 | 95 | 4.00 |
| 6 | A2 | 75 | B6 | 25 | *1 | 1.25 | 101 | 0.70 |
| 7 | A2 | 83 | B7 | 17 | *1 | 0.85 | 100 | 0.80 |
| 8 | A2 | 93 | B8 | 7 | *1 | 0.35 | 92 | 8.00 |
| 9 | A2 | 88 | B9 | 12 | *2 | 0.60 | 103 | 0.30 |
| 10 | AB1/100 weight % | | | | *1 | 0.38 | 97 | 3.00 |
| 11 | A1 | 60 | B3 | 40 | *1 | 6.00 | 91 | 0.07 |
| 12 | A1 | 90 | B4 | 10 | *1 | 0.10 | 85 | 20.00 |
| 13 | A3 | 85 | B10 | 15 | — | — | 115 | 8.00 |
| 14 | A1 | 90 | B10 | 10 | — | — | 93 | 15.00 |

*1: Itaconic acid,
*2: Maleic acid,
Inv.: Inventive,
Comp.: Comparative

Toners 1 to 11 of the invention and 12 to 14 for comparison were each mixed with ferrite carrier coated with silicone resin having a volume average size of 60 μm in a ratio of 6% by weight to prepared double-component Developers 1 to 11 of the invention and 12 to 14 for comparison.

Evaluation

The toners were successively charged in a digital color multifunctional peripheral Bizhub PRO C500, manufactured by Konica Minolta Business Technology Inc., and evaluated as to the following items under a condition of 20° C. and 55% RH. An image having a pixel ratio of 10% (an original image including a character images of pixel ratio of 7%, a portrait image, a white solid image and a black solid image each occupied ¼ of the area of the original image) was printed on an A4 size high quality paper having a weight of 64 g/m$^2$.

(Low Temperature Fixing Suitability)

The surface temperature of the heating roller of the fixing device of the above evaluation machine was set at every 10° C. within the range of from 80 to 150° C. and the toner image was fixed at each the temperature to form printed images. A4 size high quality paper having a weight of 80 g/m$^2$ was used for preparation of the printed image.

The strength of thus obtained fixed image was evaluated by a method according to the mending tape peeling method described in "Denshi Shashin Gijutsu no Kiso to Ouyou (Fundamentals and application of Electrophotographic Technology)" edited by the Society of Electrophotography of Japan, Section 9, Item 1.4. In concrete, a solid black image of 2.54 cm square having a adhering toner amount of 0.6 mg/cm$^2$ was prepared and optical density of measured before and after adhering and peeling of Scotch Mending Tape, manufactured by 3M, was measured and the remaining ratio of the image density was calculated as a fixing ratio.

The surface temperature of the image receiving material (paper P) necessary for obtaining a fixing ratio of not less than 95% is defined as the lowest fixing temperature. The image density was measured by reflective densitometer RD-918, manufactured by Gretag Macbeth. Ones showing a lowest fixing temperature of not less than 100° C. was judged as acceptable level and the samples were ranked out according to the following norms.

A: The lowest fixing temperature was less than 100° C.

B: The lowest fixing temperature was within the range of from 100° C. to less than 130° C.

C: The lowest fixing temperature was not less than 130° C.

Parting Ability (Anti-Winding Ability)

The parting conditions between the image side fixing roller and the paper was evaluated by fixing a A4 size paper having a solid black image having a width of 5 cm in the direction crossing at a right angle with the conveying direction of the paper according to the following norms. The paper was conveyed in the length direction. The samples ranked as A to C were judged as acceptable.

A: The Paper was parted form the fixing roller without touching to the parting claw and no curling was caused.

B: The paper was parted from the fixing roller by the parting claw and any mark of parting claw was not caused in the image.

C: The paper was parted from the fixing roller by the parting claw and marks of parting claw were almost not appeared.

D: The paper could be parted from the fixing roller by the parting claw by marks of the parting claw were apparently formed on the image or the paper could not parted form the fixing roller since the paper was winded on the fixing roller.

TABLE 4

| Toner No. | Low temperature fixation suitability | Parting ability | Remarks |
|---|---|---|---|
| 1 | A | C | Inventive |
| 2 | B | A | Inventive |
| 3 | B | A | Inventive |
| 4 | A | A | Inventive |
| 5 | B | B | Inventive |
| 6 | B | A | Inventive |
| 7 | A | A | Inventive |
| 8 | A | B | Inventive |
| 9 | B | A | Inventive |
| 10 | A | A | Inventive |
| 11 | B | B | Inventive |
| 12 | B | D | Comparative |

TABLE 4-continued

| Toner No. | Low temperature fixation suitability | Parting ability | Remarks |
|---|---|---|---|
| 13 | C | D | Comparative |
| 14 | A | D | Comparative |

It is understood from Table 4 that the toners of the invention are superior to the comparative inventions in both of the low temperature fixation suitability and the parting ability.

The invention claimed is:

1. A toner for developing an electrostatic image comprising toner particles each having a binder resin, a colorant and wax, wherein the softening point Tsp of the toner is from 90° C. to 110° C., and the toner satisfies the relation of 0.02=(Sw/S)×100=10, wherein Sw is an area of a wax domain having largest diameter among wax domains at a cross section of the toner particle, and S is entire area of the cross section of the toner particles, wherein content of the wax in the toner particles is 1 to 30% by weight.

2. The toner of claim 1, wherein Sw/S is from 0.02 to 3.

3. The toner of claim 1, wherein Tsp of the binder resin is from 90 to 100° C.

4. The toner of claim 1, wherein the binder resin contains a vinyl polymerizable monomer having two or more polar groups in an amount of from 0.2 to 4.0% of the whole polymerizable monomers composing the binder resin.

5. The toner of claim 4, wherein the polar group is a carboxyl group.

6. The toner of claim 4, wherein the vinyl polymerizable monomer having two or more polar groups is itaconic acid or maleic acid.

7. The toner of claim 6, wherein the vinyl polymerizable monomer having two or more polar groups is itaconic acid.

8. The toner of claim 1, wherein monomers composing the binder resin contain propyl acrylate, propyl methacrylate, butyl acrylate or 2-ethylhexyl acrylate.

9. The toner of claim 1, wherein the wax has a melting point of from 60 to 90° C.

* * * * *